US011324987B2

(12) United States Patent
Quintana

(10) Patent No.: US 11,324,987 B2
(45) Date of Patent: May 10, 2022

(54) BAR AND DISC SET WITH COUPLING ELEMENTS

(71) Applicant: Pedro Antonio Aguilar Quintana, Valencia (ES)

(72) Inventor: Pedro Antonio Aguilar Quintana, Valencia (ES)

( * ) Notice: Subject to any disclaimer, the term of this patent is extended or adjusted under 35 U.S.C. 154(b) by 7 days.

(21) Appl. No.: 16/930,359

(22) Filed: Jul. 16, 2020

(65) Prior Publication Data

US 2021/0016128 A1 Jan. 21, 2021

(51) Int. Cl.
*A63B 21/072* (2006.01)

(52) U.S. Cl.
CPC ..... *A63B 21/0728* (2013.01); *A63B 21/0724* (2013.01); *A63B 21/0726* (2013.01)

(58) Field of Classification Search
CPC ..... A63B 21/072; A63B 21/0724; A63B 21/0726; A63B 21/0728; A63B 21/075
See application file for complete search history.

(56) References Cited

U.S. PATENT DOCUMENTS

| | | | | |
|---|---|---|---|---|
| 4,738,446 | A * | 4/1988 | Miles | A63B 21/0728 24/580.11 |
| 5,484,367 | A * | 1/1996 | Martinez | A63B 21/0728 482/107 |
| 6,682,464 | B2 * | 1/2004 | Shifferaw | A63B 21/0728 482/104 |
| 7,087,000 | B1 * | 8/2006 | Walker | A63B 21/0728 482/106 |
| 7,172,536 | B2 * | 2/2007 | Liu | A63B 21/0728 482/108 |
| 7,611,448 | B2 * | 11/2009 | Schiff | A63B 21/075 482/107 |
| 7,811,213 | B2 * | 10/2010 | Chen | A63B 21/075 482/108 |
| 10,195,476 | B2 * | 2/2019 | Jennings | A63B 21/075 |
| 11,052,276 | B1 * | 7/2021 | Baker | A63B 21/0724 |
| 2012/0238416 | A1 * | 9/2012 | Becker | A63B 21/0728 482/107 |

* cited by examiner

*Primary Examiner* — Joshua Lee
(74) *Attorney, Agent, or Firm* — Bay State IP, LLC

(57) ABSTRACT

A bar and weight discs assembly with disc holding elements intended for sports reveals a set with a bar and at least one disc for weight exercises or weightlifting, where said set is obtained by coupling the discs to the bar without the need to use other coupling means such as bar clamps or safety collars, the set can be used both for an exercise bar of the conventional type of 28 mm in diameter or for an Olympic bar of 50 mm in diameter, as well as the discs that are inserted in the bar (1) which can be of different weights.

4 Claims, 1 Drawing Sheet

BAR AND DISC SET WITH COUPLING ELEMENTS

OBJECT OF THE INVENTION

The present invention relates to a bar and weight discs assembly with disc holding elements intended for sports, such as weightlifting, and more particularly such exercise apparatus that include means for supporting a series of weight discs at both ends of a bar, where the coupling elements prevent the discs from shifting off the bar.

BACKGROUND OF THE INVENTION

Weightlifting is performed in various sports and medical therapies using weight discs attached to bars. Said weights are made up of a bar and at least two weight discs that are located at opposite ends of the bar, forming the set with a balanced distribution of its total weight, suitable for the athlete to lift.

In the past and present, gyms and health clubs that provide free weights to their clients also provide bar clamps or safety collars to secure the weight discs on a bar and/or dumbbell. This would allow the end user or weightlifter to use the weights without their sliding or shifting on the bar during use, allowing the end user to lift the set more safely.

For the correct use of the weight discs and bar it is essential that the coupling between the discs and the bar, in addition to being simple, is made firmly and with adequate security to prevent the discs from slipping from their position on the bar, which can imply risks of accident or injury for the user in case that a disc falls on the user if it slides off the bar. To carry out such a clamping, it is common for conventional barbell weights to include rings with nuts, clips, etc. configured to fit the bar at its external ends towards the position of the discs, thus limiting the movement of the discs along said bar.

U.S. Pat. No. 4,618,143 (Twardosz) discloses a weight lifting bar that has coupling elements with respect to the longitudinal axis of the bar, so that an athlete can perform lifting exercises for different muscle groups, where the safety of the bar for the displacement and fall of the discs is carried out by concentric rings in the form of a clamp as coupling elements.

Schook's U.S. Pat. No. 4,566,690 and Kupferman's U.S. Pat. No. 5,407,413 disclose two of the typical dumbbells that each include one or more weight discs that are each secured one at a time. However, a lot of time is spent in mounting the weight discs.

Chen's American patent application US 2002/0183174 A1 discloses a dumbbell where the weights can be selectively coupled to the handle by means of a closure slidably received in said handle and which extends through the central recess of the weights. By sliding the lock further out, it is possible to increase the number of weights attached to the handle, while sliding the lock closer in can reduce the number of weights. This allows the user of the handle to change the total weight of the handle without moving the weights themselves.

The technical problem underlying the present invention consists in providing a set of discs and bar that allows adjusting the bar and the disc without the need to use couplings at the ends of the bar to hold the discs, avoiding slipping and falling of the discs, in such a way that it is not necessary to put pressure on the union between the discs and the bar, as well as their sliding, so it provides greater security to the user as well as greater speed when executing the exercises, as it avoids using other external elements.

DESCRIPTION OF THE DRAWINGS

To complement the description that is being made and in order to help a better understanding of the characteristics of the invention, in accordance with a preferred example of the practical embodiment of the same, is accompanied as an integral part of said description, a set of drawings in which, by way of illustration and not limitation, the following has been represented.

DESCRIPTION OF THE INVENTION

Figure 1:
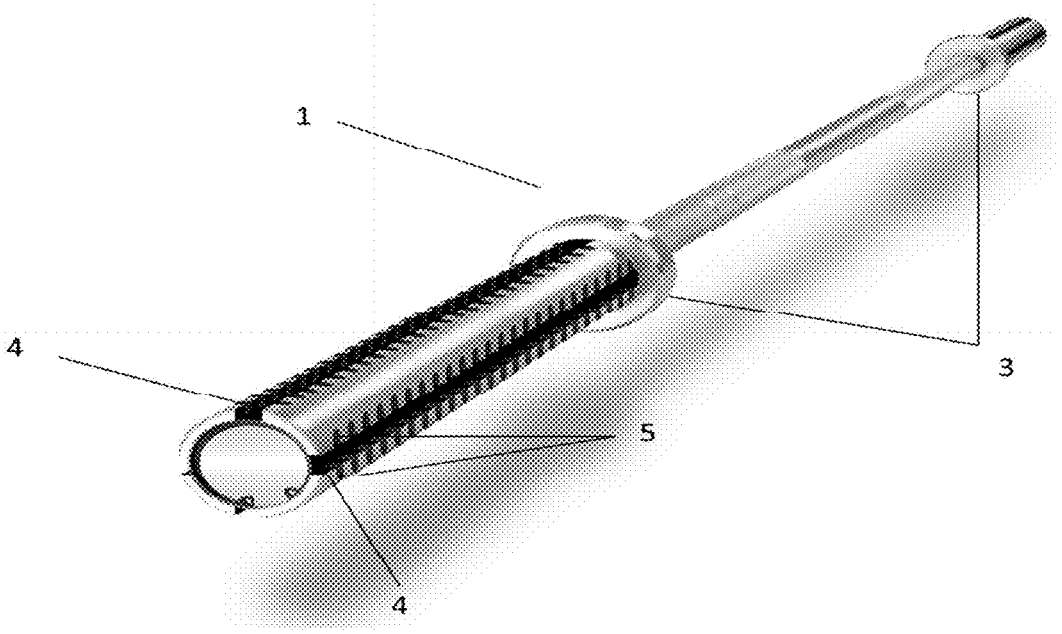
FIG. 1.—Shows a view of the exercise bar (1) of the present invention, where can be seen the plurality of rails (4) and the holes (5) above and below the bar (1).
Figure 2:
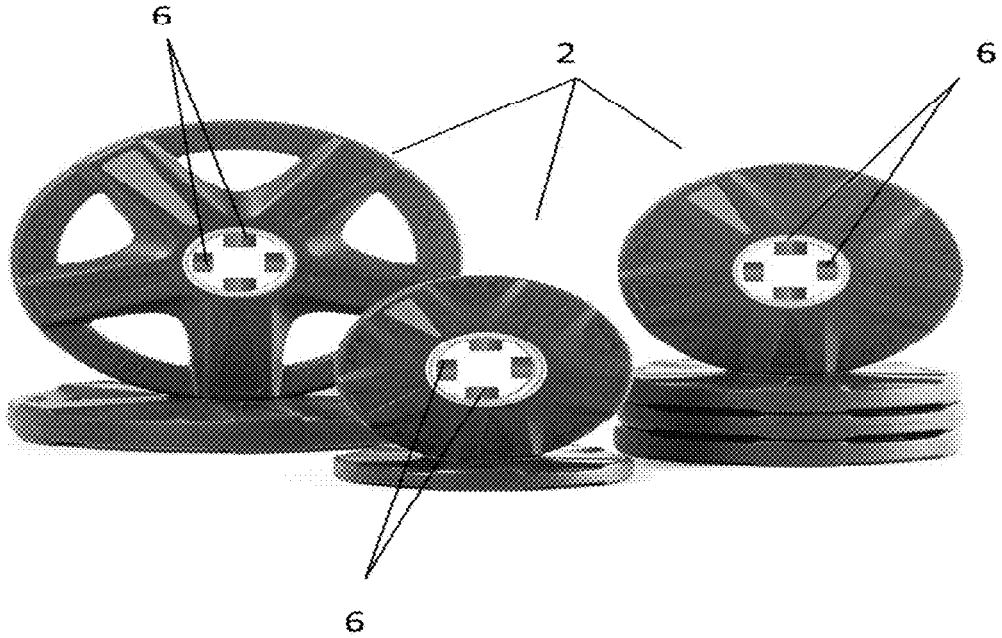
FIG. 2.—Shows a view of the different discs (2) that can be used with the bar (1), where the pins (6) are shown in each of the discs (2).

The present invention reveals a set consisting of a bar (1) and at least one disc (2) for weight exercises or weightlifting, where said set is obtained by coupling the discs (2) to the bar (1) without the need to use other coupling means such as bar clamps or safety collars, the set can be used both for an exercise bar (1) of the conventional type of 28 mm in diameter or for an Olympic bar (1) of 50 mm in diameter, as well as the discs (2) that are inserted in the bar (1) which can be of different weights.

The bar (1) has two stops (3) at a certain distance from the ends of the bar (1), at each end of the bar a plurality of rails (4) have been made that extend between the ends of the bar (1) and the stops (3). Each of said rails (4) has a plurality of holes (5) above and below said rails (4).

The discs (2) each have at least 4 pins (6) which, inserted in the hole (5) of the bar (1), prevent the discs (2) that have been previously inserted in the end of the bar from coming out (1) at the time of placing the load formed by said discs (2).

The set allows a comfortable coupling of the discs (2) with the bar (1), in such a way that it is not necessary to apply pressure to place the discs (2) and the bar (1), as well as avoiding their sliding.

By having a greater coupling due to the effect of the pins (6) in the discs (2) and the holes (5) in the bar (1), it is not necessary to implement external clamps in order to prevent the discs from sliding and coming off the bar (1), so that the user, in addition to obtaining greater security, can change the discs (2) quicker, since he does not need to uncouple external elements that hold the discs in place (2).

The invention claimed is:

1. A bar and disc assembly comprising:

a bar (1) with a first end and a second end; and a plurality of weight discs (2);

wherein the first end and the second end each further comprises a stop (3) and a plurality of rails (4) extending between the respective end of the bar (1) and the respective stop (3);

wherein each of the plurality of rails (4) is disposed over a circumference of the first end and the second end of the bar;

wherein each of the plurality of rails (4) further comprises a plurality of holes (5) located orthogonally on both sides along a length of said rails (4); and wherein the plurality of weight discs (2) comprises at least 4 pins (6) fixedly attached to an inner circle of the plurality of weight discs (2) that allow the plurality of weight discs (2) to be inserted into the plurality of rails and be secured via the plurality of holes (5) of the bar (1).

2. The bar and disc assembly according to claim 1, which is characterized in that the bar (1) is a conventional bar of 28 mm diameter.

3. The bar and disc assembly according to claim 1, which is characterized in that the bar (1) is an Olympic bar of 50 mm diameter.

4. The bar and disc assembly according to claim 1, which is characterized in that the plurality of weight discs (2) are of different weights.

* * * * *